US005910710A

United States Patent [19]

Simpson

[11] Patent Number: 5,910,710

[45] Date of Patent: Jun. 8, 1999

[54] METHOD AND APPARATUS FOR POWERING AN ELECTRODELESS LAMP WITH REDUCED RADIO FREQUENCY INTERFERENCE

[75] Inventor: James E. Simpson, Gaithersburg, Md.

[73] Assignee: Fusion Lighting, Inc., Rockville, Md.

[21] Appl. No.: 08/754,858

[22] Filed: Nov. 22, 1996

[51] Int. Cl.[6] ..... H05B 41/16

[52] U.S. Cl. ..... 315/248; 315/39; 315/236; 315/344

[58] Field of Search ..... 315/248, 39, 267, 315/344, 236; 333/81 A, 81 B, 81 R, 204, 205, 219, 246; 219/709

[56] References Cited

U.S. PATENT DOCUMENTS

| | | | |
|---|---|---|---|
| 3,662,140 | 5/1972 | Jones et al. | 219/10.55 |
| 4,060,778 | 11/1977 | Hefni et al. | 333/73 W |
| 4,069,456 | 1/1978 | Bensussan et al. | 328/165 |
| 4,359,668 | 11/1982 | Ury | 315/39 |
| 4,716,389 | 12/1987 | Gawronski et al. | 333/81 A |
| 4,859,906 | 8/1989 | Ury et al. | 313/639 |
| 4,894,592 | 1/1990 | Ervin et al. | 315/248 |
| 5,070,277 | 12/1991 | Lapatovich | 315/248 |
| 5,113,121 | 5/1992 | Lapatovich et al. | 315/248 |
| 5,227,698 | 7/1993 | Simpson et al. | 315/248 |
| 5,361,274 | 11/1994 | Simpson et al. | 372/72 |
| 5,404,076 | 4/1995 | Dolan et al. | 313/572 |
| 5,448,135 | 9/1995 | Simpson | 315/39 |
| 5,504,391 | 4/1996 | Turner et al. | 313/570 |

*Primary Examiner*—Don Wong
*Assistant Examiner*—Haissa Philogene
*Attorney, Agent, or Firm*—Epstein, Edell & Retzer

[57] ABSTRACT

An electrodeless lamp waveguide structure includes tuned absorbers for spurious RF signals. A lamp waveguide with an integral frequency selective attenuation includes resonant absorbers positioned within the waveguide to absorb spurious out-of-band RF energy. The absorbers have a negligible effect on energy at the selected frequency used to excite plasma in the lamp. In a first embodiment, one or more thin slabs of lossy magnetic material are affixed to the sidewalls of the waveguide at approximately one quarter wavelength of the spurious signal from an end wall of the waveguide. The positioning of the lossy material optimizes absorption of power from the spurious signal. In a second embodiment, one or more thin slabs of lossy magnetic material are used in conjunction with band rejection waveguide filter elements. In a third embodiment, one or more microstrip filter elements are tuned to the frequency of the spurious signal and positioned within the waveguide to couple and absorb the spurious signal's energy. All three embodiments absorb negligible energy at the selected frequency and so do not significantly diminish the energy efficiency of the lamp.

35 Claims, 5 Drawing Sheets

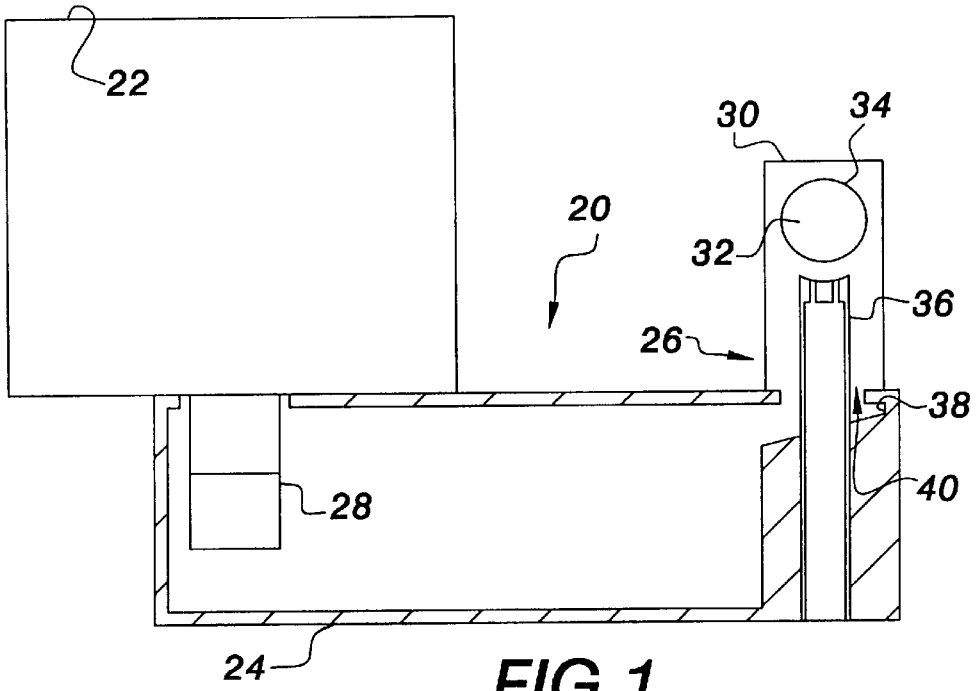
FIG.1
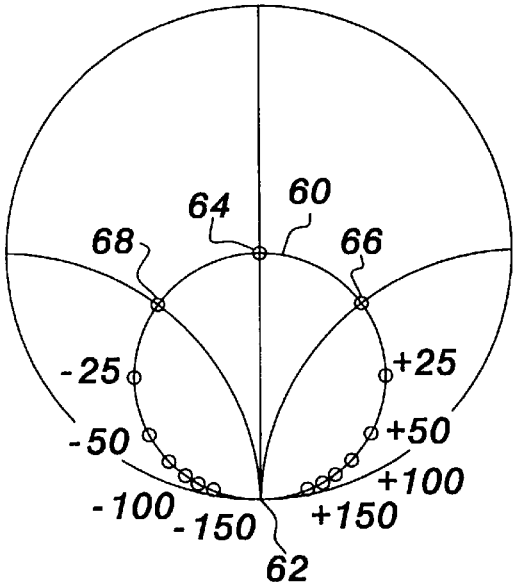
FIG.2
FIG.3
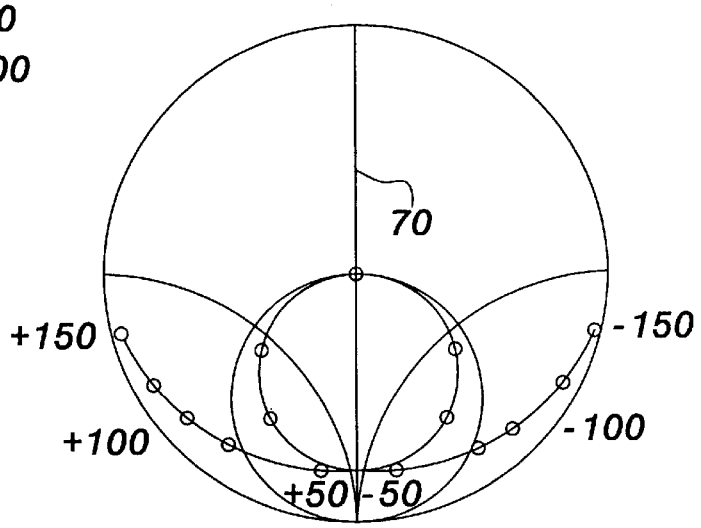

METHOD AND APPARATUS FOR POWERING AN ELECTRODELESS LAMP WITH REDUCED RADIO FREQUENCY INTERFERENCE

This invention was made with Government support under Contract No. DE-FG01-95EE23796 awarded by the Department of Energy. The Government has certain rights in this invention.

BACKGROUND OF THE INVENTION

1. Technical Field

The present invention pertains to improvements in methods and apparatus for powering an electrodeless lamp with reduced Radio Frequency Interference (RFI). This invention has particular, although not limited, utility in lamps of the types disclosed in U.S. Pat. Nos. 5,504,391 (Turner et al), 5,448,135 (Simpson ), 5,404,076 (Dolan et al), 4,894,592 (Ervin et al), 4,859,906 (Ury et al), and 4,359,668 (Ury); the disclosures of these patents are incorporated herein by reference.

2. Discussion of the Prior Art

Electrodeless lamps of the type with which the present invention is concerned include a light transmissive envelope containing a plasma-forming medium known as fill. A microwave or Radio Frequency (RF) energy source has its output energy coupled to the envelope via a waveguide to excite a plasma in the fill, resulting in the discharge of light from the envelope.

FIG. 1 schematically illustrates one of the many possible configurations for an electrodeless lamp of the type with which the present invention is concerned. A lamp module 20 includes a magnetron 22 or some other source of RF or microwave electromagnetic energy. Energy from the magnetron 22 is coupled to a waveguide 24 via a coupling antenna 28 and into a screen cavity 30, in which a bulb 32 is disposed. Bulb 32 includes a generally spherical discharge envelope 34. The bulb 32 has a high pressure fill material contained within its discharge envelope 34 such as, for example, the material described in the above-referenced Dolan et al patent. Bulb envelope 34 is made of quartz or some other suitably transparent material. The screen cavity 30 is made from a conductive mesh or screen material opaque to RF or microwave radiation but transparent to light radiation.

In operation, the waveguide 24 directs the electromagnetic energy generated by the magnetron 22 into the screen cavity 30, exciting the fill atoms of noble gas (e.g., xenon, argon, krypton, etc.) in bulb 32, which is initially at room temperature, to effect discharge of electrons. The discharged electrons collide with other fill atoms causing a further discharge of electrons, thereby increasing the total population of free electrons. The increased population of free electrons results in increased collisions and increased temperature, and other atoms of solid or liquid fill material, such as sulfur, mercury, etc., are vaporized and emit the desired light radiation.

For compact lamp configurations, a coaxial resonator 26 includes screen 30 as an outer conductor, a center conductor 36 which preferably is hollow to carry cooling air, bulb 32, and coupling loop 40 which is used to provide a high voltage, exciting the electrodeless lamp bulb at a high energy density. Power is coupled from the waveguide to the resonator by a coupling loop 40 in which a horizontal RF magnetic field enters notch 38 behind conductor 36, inducing current in the base of the center conductor 36.

Difficulties have been encountered with the operation of the magnetron in the compact lamp configuration and in other lamps with a compact, highly resonant RF circuit. These difficulties are encountered in spite of careful impedance matching in the design of the lamp RF circuit. Impedance matching, in this context, refers to matching the bulb's impedance at full operating temperature to that of waveguide 24 whereby the impedance at antenna 28 is equal to the characteristic impedance for an RF circuit specified by the magnetron's manufacturer. A mismatch in impedance causes reflected RF energy to propagate back from the area of the mismatch and produces a higher Voltage Standing Wave Ratio (VSWR) than for a matched RF circuit. Thus, VSWR is used as a measure of impedance matching. For purposes of nomenclature, the lamp RF circuit includes the coupling antenna 28, the waveguide 24, the resonator 26 including the screen cavity 30 containing bulb 32, the RF load to be excited. In evaluating prototypes for compact lamps, it has been observed that, for compact RF circuit configurations, the VSWR is within acceptable limits at the selected frequency of operation for the magnetron, according to specifications provided by the manufacturer of the magnetron. In spite of this, the magnetron is adversely affected by the short waveguide and resonator 26 and exhibits unexpected behavior. Instead of the single selected frequency, multiple, spurious frequencies are observed in the magnetron output spectrum. As a result, lamp performance is adversely affected in two ways; the lamp light flickers in an unacceptable manner and the spurious frequencies produced are outside the 2400 MHZ to 2500 MHZ ISM band allocated under governmental guidelines for RF spectrum management. Spurious signals above and below the allocated band have been observed simultaneously. The frequencies produced change with the length of the waveguide between the magnetron and the lamp bulb.

Considerable research has resulted in no guidance as to how this unexpected problem may be alleviated. There is no information from the manufacturer of the magnetron on the phenomenon of high reflections at frequencies differing significantly from the magnetron operating frequency, where there is a good impedance match at the selected operating frequency. In fact, the manufacturer of one magnetron denies that it is possible to create a condition of oscillation at widely separated frequencies for RF circuits with an adequately matched impedance at the selected frequency.

In normal RF circuit design practice, the manufacturer provides design guidelines based on RF circuits with a matched characteristic impedance at the selected frequency of operation for a given magnetron. A magnetron is specified as having a given range of frequencies of operation and, in theory, the designer simply chooses a magnetron for oscillation at the selected frequency.

In the present situation, it appears that even though there is a well-matched load at the selected operating frequency, the magnetron (together with the lamp RF circuit) may also oscillate at a second or third widely separated frequency, 30 MHZ to 100 MHZ to either side of the selected frequency, when a VSWR of 20:1 or greater is present at the widely separated frequency. Thus, using the methods of the prior art, it is not possible to prevent spurious Radio-Frequency Interference (RFI) in electrodeless lamps having the shorter and more compact waveguide configurations. Unless a way is found to prevent the RFI emissions, fabrication of the smaller and more desirable electrodeless lighting fixtures will not be possible.

OBJECTS AND SUMMARY OF THE INVENTION

Accordingly, it is an object of the present invention to minimize radiation of RFI by providing an electrodeless lamp with a compact configuration and an improved short waveguide.

Another object of this invention to provide an improved compact waveguide for eliminating problems with magnetron frequency pulling.

It is a further object of this invention to provide a compact waveguide structure for absorbing energy at only out-of-band frequencies while passing substantially all of the energy produced by the RF source at the selected frequency.

As part of the present invention, it has been discovered that the RFI problem arises from pulling of the magnetron frequency by high reflections (and hence high VSWR) at frequencies outside of the selected band of operating frequencies. A lamp waveguide with an integral frequency selective attenuation has been developed; this waveguide includes resonant absorbers positioned within the waveguide to absorb spurious out-of-band RF energy. The absorbers have a negligible effect on energy at the selected frequency used to excite the plasma in the lamp.

In a first embodiment of the present invention, one or more thin slabs of lossy energy absorbing material is affixed to the sidewalls of the waveguide at a distance approximately one quarter wavelength from an end wall of the waveguide; the position of each slab is chosen as a function of the guide wavelength of the spurious signal. The positioning of the lossy material optimizes absorption of power from the spurious signal; otherwise, the spurious signal behaves like a standing wave within the waveguide.

In a second embodiment of the invention, a quantity of lossy absorber material sufficient to partially terminate the waveguide is used in conjunction with a band rejection waveguide filter that is tuned to the selected operating frequency. In a third embodiment, one or more tuned microstrip energy receiving absorbers are tuned and strategically positioned within the waveguide to absorb the spurious signal energy. All three embodiments absorb negligible energy at the selected frequency and so do not significantly diminish the energy efficiency of the lamp.

Three embodiments are disclosed; in each, an energy absorber is disposed within the waveguide. In the first embodiment, a broadband lossy absorber is made resonant, or frequency selective, by virtue of the position of the absorber within the waveguide. In the second embodiment, a band rejection filter is used to selectively allow only spurious energy to reach an (otherwise broadband) absorber, thus the absorber is resonant, or frequency selective, by virtue of its use in conjunction with a band rejection filter. In the third embodiment, a frequency selective microstrip absorber is disposed within the waveguide. In each of the three embodiments, therefore, the absorbers are tuned to absorb energy at the frequency of the spurious signal and so, for purposes of nomenclature, each of the three embodiments is deemed to include a resonant absorber.

The foregoing and additional objects, features and advantages of the invention will become apparent to those of skill in the art from the following detailed description of a preferred embodiment, taken with the accompanying drawings wherein like reference numerals in the various drawings identify like components.

BRIEF DESCRIPTION OF THE DRAWINGS

FIG. 1 schematically illustrates a cross-section side view of one example of an electrodeless lamp of the type with which the present invention is utilized.

FIG. 2 is a Smith chart diagram illustrating the impedance of a resonant RF circuit with an ideal resonator matched to a waveguide at the resonant frequency.

FIG. 3 is a second Smith chart diagram illustrating the effect of adding a one wavelength long section of waveguide to the resonant RF circuit charted in FIG. 2.

DESCRIPTION OF THE PREFERRED EMBODIMENTS

Figure 4:
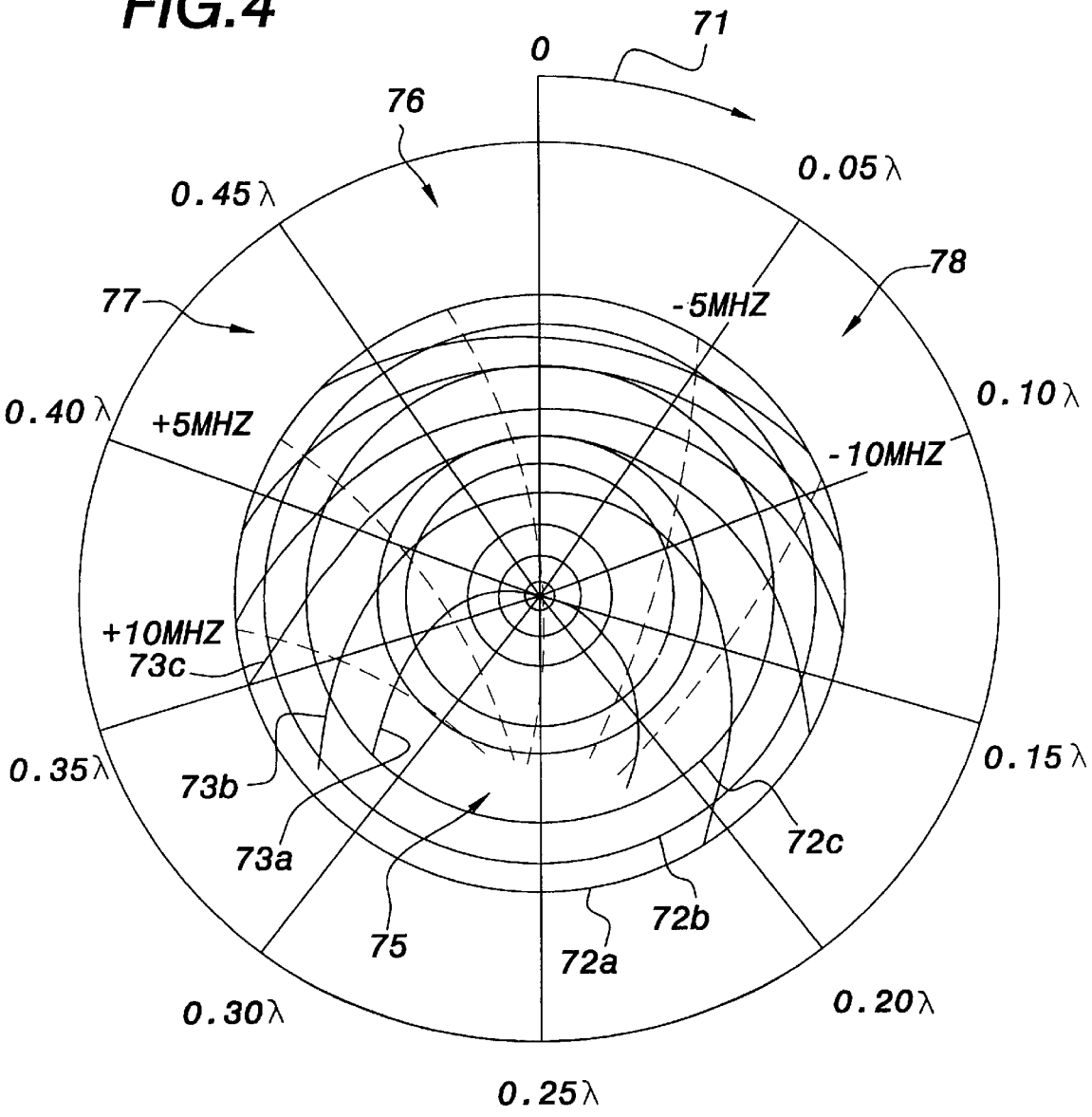
FIG. 4 is a Rieke diagram illustrating observed magnetron output power and frequency as a function of load conductance (and susceptance), for a fixed magnetic field and anode current.

It has been discovered that the problem of spurious emissions, causing pulling of the magnetron frequency, is exacerbated by unwanted reflections within the waveguide. The spurious emissions are widely separated in frequency from the selected frequency of the magnetron and are reflected within the waveguide. If the spurious emissions are removed, the magnetron operates at the selected frequency.

The mechanism by which unwanted frequency pulling occurs may be understood by considering the impedance of a resonant circuit portrayed on a polar impedance diagram (or Smith Chart), as shown in FIG. 2. The Smith Chart is a graphical representation of the impedance of a transmission line (or waveguide), generally. For a given reference position in a waveguide, impedance is normalized to a standard value (e.g., 50 ohms) and then may be plotted as a point. The Smith chart is useful for modeling how impedance changes as the reference position is moved toward the generator (i.e., the magnetron 22) or toward the load (i.e., the bulb 32). The Smith Chart is also useful to plot impedance changes for a given reference position within a waveguide, as a function of frequency; this is the purpose of FIGS. 2 and 3. Turning now to FIG. 2, it is shown that at a reference plane located at the loop coupling resonator 26, a resonant circuit impedance appears as a circle 60, tangent to the edge of the chart 62 at zero impedance. For stable magnetron operation, the length of the transmission line joining the magnetron to the resonator must place zero impedance point 62 in the "sink" phase of the magnetron's performance characteristic.

Negative feedback of frequency offsets is obtained with this phasing since the magnetron pulling characteristic, represented by the dashed frequency difference lines in FIG. 4, forces the operating frequency toward a central value.

To build a working system, for example, as illustrated in FIG. 1, there must be a length of transmission line (or waveguide) between the magnetron 22 and the coupling point of the resonator 26. The transmission line length also includes a portion inside the magnetron 22 between the antenna 28 and the anode resonator (i.e., the point inside the magnetron at which the oscillation frequency is determined). Reflections from the load (i.e., bulb 32) experience a phase shift in the transmission line length, the phase shift increasing as a function of frequency. The low and high frequency loci, formerly having met at tangent point 62 at the edge of the chart, now overlap and form a loop.

FIG. 2 illustrates the impedance plot of an ideal resonator matched to the incoming transmission line or waveguide at resonant frequency $f_0$ shown at point 64, with a loaded bandwidth of ±25 MHZ. Impedances for offset frequencies at multiples of ±25 MHZ are shown (as well as for ±12.5 MHZ, at points 66 and 68; ±12.5 MHZ is the unloaded bandwidth for such a resonator). Turning now to FIG. 3, there is illustrated the effect of adding a section of WR-340 waveguide having a length of one full wavelength at 2450 MHZ, assumed herein to be the resonance frequency $f_0$. Frequencies below $f_0$ are shifted counterclockwise while frequencies above $f_0$ are shifted clockwise, crossing the center line of the chart 70 for both cases.

Turning now to FIG. 4, a Rieke diagram (or load diagram) is illustrated. The Rieke diagram is a chart showing changes in the output power and frequency of magnetron 22 as a function of load impedance, at a reference plane corresponding to the antenna 28. The directional arrow 71 indicates movement toward the load. The concentric circles, 72*a*, 72*b*, 72*c*, are lines of constant VSWR and increase with increasing diameter; line 72*a* corresponds to a VSWR of 5.0, line 72*b* to a VSWR of 4.0, line 72*c* to a VSWR of 3.0, and so forth. The center of the chart corresponds to a VSWR of 1.0, a perfect impedance match. The curved lines of increasing radius, 73*a*, 73*b*, 73*c* are lines of constant output power and decrease with increasing radius; line 73*a* corresponds to a power of 900 watts, line 73*b* to a power of 850 watts, line 73*c* to a power of 800 watts, and so forth. The region of higher power 75 is called the sink region and represents the greatest coupling to the magnetron and the highest efficiency. Operation in the sink region, however, typically results in reduced frequency stability. The lower power region 76 is where the magnetron is lightly loaded; it is expected that the buildup of oscillations will be more stable there. For magnetrons of the type used in this lamp, data is supplied only for VSWR values of 5:1 to 10:1. Higher VSWR values (which indicate higher amplitude reflections), especially in the heavily loaded sink phase, are described as a forbidden region to be avoided by the designer (in the literature provided by the manufacturer). Frequency pulling contours and power contours on the lightly loaded side of the center 76 resemble the reactance and resistance contours of a polar impedance diagram (or Smith Chart). It is possible that this similarity continues on the sink side of the Rieke diagram, at least near the edges where VSWR is greater than 20:1. If so, there are regions of very high pulling factor near the chart edge and in the middle of the sink region. In general, pulling raises frequency on the left side of the center of the chart 77 and lowers frequency on the right side 78. If a pulling frequency point in the heavily loaded area 75 of the Rieke diagram and a load impedance value (from a portion of the impedance locus in FIG. 3 in which the center axis has been crossed) were to coincide at a given frequency, an unwanted oscillation would result.

Whatever the mechanism for producing the frequency instability, laboratory observations of resonant electrodeless lamps with very small bulbs have shown the presence of spurious signals at frequencies in the range of 30 to 100 MHZ on either side of the selected operating frequency $f_0$. In most cases, these spurious signals are strong and are not equally displaced from the selected frequency and thus are not likely to have been caused by amplitude or frequency modulation of the selected frequency $f_0$. When the spectral plot is observed and the resonator 26 (FIG. 1) is tuned, both the high side and the low side frequency signal components have been observed to change in the same direction (i.e., both higher or both lower in frequency).

Laboratory test results on narrow bandwidth resonant lamps have provided observations which appear to agree with the analysis as outlined above. It appears that at spurious signal frequencies (30 to 100 MHZ above and below $f_0$), the overlapping of the frequency impedance loop causes a magnetron pulling characteristic. Shortening the distance between source and load rotates the impedance diagram counterclockwise, raising the frequency of both the low and high side spurious signals, thus exacerbating the problem with frequency instability.

In larger lamps (not necessarily including a coaxial resonator 26 to provide power coupling to the bulb), the operating bandwidths are much wider. Out-of-band signals are also seen with larger lamps, although at lower relative amplitudes. The mechanism for generation of spurious RFI signals may be similar, since the unwanted signals change frequency when the waveguide lengths are changed. Another factor contributing to RFI generation in the larger lamps is the use of unfiltered high voltage Direct Current (DC) power supplies for driving the magnetron. Small lamps with narrow resonant bandwidths are apt to require a more highly filtered DC supply in order to maximize bulb coupling. Larger lamps can provide high efficiency in spite of the frequency modulation (tens of MHZ) caused by unfiltered operation. Unwanted and out-of-band spurious signals can be produced during periods of low or rapidly changing magnetron supply current.

Thus, a number of mechanisms for unwanted generation of spurious signals in an electrodeless lamp have been identified. Both larger, broadband, and smaller, narrowband lamps are affected. In the method of the present invention, a RF circuit is assembled and then tested. The amplitude and frequency of each spurious signal are then determined.

According to the preferred embodiment of the present invention, a small amount of attenuation is introduced into waveguide 24, thereby reducing the VSWR of the waveguide for spurious signals. When attenuation is sufficient, the unwanted oscillation is reduced to a low amplitude (or preferably eliminated completely); this is so because the impedance contour in FIG. 3 shrinks toward the center and no longer coincides with the points on the frequency pulling characteristic in the region of instability.

The use of attenuation within the waveguide sacrifices at least some of the useful (forward) power which would otherwise be used to drive the lamp bulb 32. It has been determined experimentally that, for prototypes of the first embodiment of the present invention, this reduction in forward power is in the range of 5% and so is negligible. In other embodiments, the attenuation is made frequency selective to reduce the impact of the attenuation on the system efficiency. In all cases, it is desirable to maximize the loading at the out-of-band frequencies while minimizing the loading or loss at the selected frequency of operation.

Figure 5:
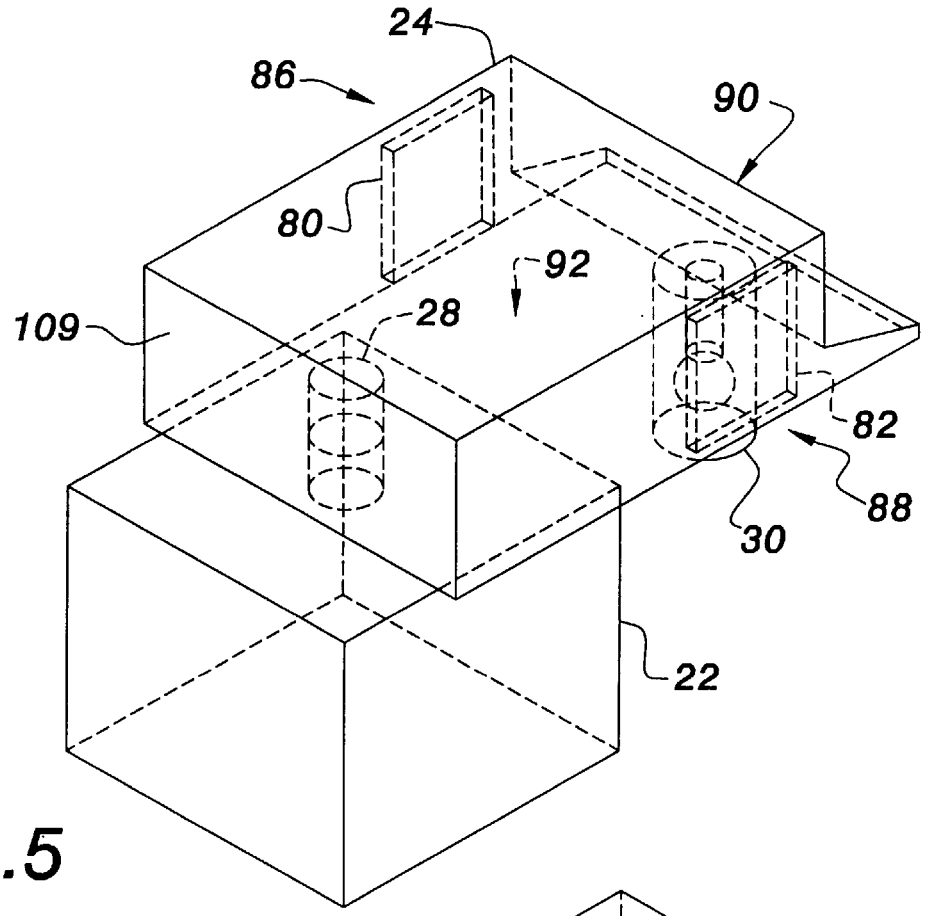
FIG. 5 is a schematic perspective illustration of the lamp of the present invention with slabs of magnetically absorptive material in the waveguide.

Turning now to FIG. 5, there is illustrated a first preferred embodiment for the present invention specially adapted for use with the small bulbs; in this embodiment, broadband attenuators are used within waveguide 24. One or more attenuating inserts 80, 82 are placed on the walls of the waveguide 24 at selected locations 86, 88 corresponding to expected high intensity locations in the electric or magnetic field. One such location 86 is on the sidewall, as illustrated in FIG. 5. The end wall of the waveguide 90 is electrically similar to a short circuit, since the resonant circuit impedance of the loop is nearly a short circuit at the unwanted frequency. Therefore, the electric (E) field is vertical and is at a maximum in the center 92 of the waveguide. The magnetic (H) field is horizontal and is at a maximum tangent to the sidewalls 86, 88. Both these maxima occur a quarter guide wavelength away from the end wall 90 (this is a function of the spurious signal wavelength, not the selected frequency wavelength). Both the E and H fields form standing waves and have a nearly doubled intensity at the quarter wavelength sites 86, 88. Power absorption for the spurious signal is thus nearly quadrupled at the spurious signal quarter wavelength locations 86, 88 as compared to absorption of the forward wave of the nearly matched center frequency signal.

An electric field attenuation element (i.e., a lossy absorber of E field power) is preferably thick, in order to couple the E field, since it is perpendicular to the top and bottom waveguide surfaces. A magnetic field loss element, 80, can be very thin however. This thinness, and the fact that the magnetic absorber 80 is adhered to the thermally conductive wall 86, improves heat transfer of the energy absorbed from the H field to the mounting wall 86.

Preferably, two thin slabs 80, 82 of lossy magnetic material (i.e., lossy absorbers of H field power) are attached to opposite side walls 86, 88 of the waveguide 24 using a thermally conductive adhesive. Heat generated in the lossy material is conducted to the waveguide walls. The absorber material contains a uniform dispersion of a lossy iron compound in a rubber base. The rubber prevents thermal expansion stress from separating the insert from the metal waveguide wall.

Blocks of silicon carbide, an electric field absorber, have also been effective in absorbing the energy of the spurious signals. Higher operating temperatures can be tolerated with the silicon carbide material. However, the lossy iron compound in the rubber base is preferred because it is possible to control the power absorption properties for the iron more closely than the silicon carbide material. A suitable magnetic absorber is an iron powder suspended in an elastomeric material such as silicone rubber. A sample 1⅜" square by 0.15" thick absorbs about 2 percent of forward power at 2450 MHZ, with or without presence of a spurious standing wave, when installed on a side wall of a WR-340 waveguide.

It is also possible to use frequency selective elements in suppressing the spurious signals. Two methods of frequency selection are described. These are the second and third embodiments of the invention. In the second embodiment, a resonance at the selected lamp operating frequency prevents forward power from getting to an attenuator or absorber. In the third embodiment, resonance at the spurious signal frequencies enhances absorption of the spurious signal power.

Figure 6:
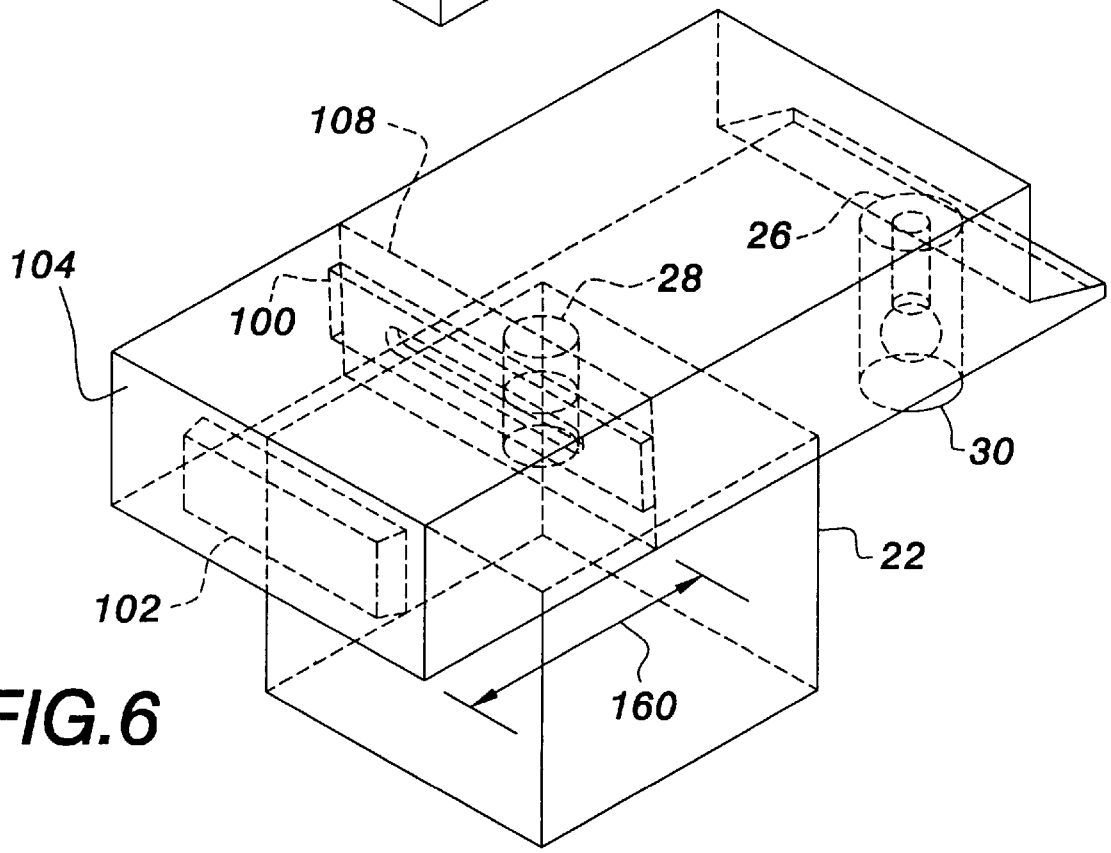
FIG. 6 is a schematic perspective illustration of a second embodiment of the lamp of the present invention with a bandstop filter element in the waveguide.

The second embodiment is illustrated in FIG. 6. A narrow-band bandstop (or band rejection) filter 100 is placed between the magnetron coupling antenna 28 and a lossy absorber or attenuator 102. Direct transmission from the magnetron 22 to the lamp resonator 26 is maintained. The bandstop filter 100 may take the form of a wire loop suspended in the middle of the waveguide between the magnetron antenna 28 and the end wall of the waveguide opposite lamp 104. A microwave load in the form of a large absorber 102 is mounted on this end wall 104. The loop 100 is resonant at the magnetron center frequency and effectively functions as a short circuit in the waveguide at the filter plane 108. The plane of loop 108 is positioned at the same distance from magnetron coupling antenna 28 as the back wall of the unaltered waveguide 109, as illustrated in FIG. 5. In the waveguide of FIG. 5, the back wall 109 is electrically a short circuit. Similarly, with the band rejection filter 100 positioned in plane 108, this end of the waveguide provides an electrical short circuit for the signal at the selected frequency. A highly resonant current flows in loop filter 100, causing some loss at the selected frequency. Spurious signals at the out-of-band frequencies, however, pass through the band rejection filter 100 and go to the absorber 102 and are at least partially absorbed by absorber 102, preferably a block of silicon carbide. Spurious signal reflections are thus reduced sufficiently to prevent magnetron oscillation at the unwanted frequency and hence prevent magnetron pulling. With the second embodiment of FIG. 6, the loss in lamp efficiency or loss in forward power is reduced to approximately 2%, a significant improvement over the efficiency for the first embodiment of FIG. 5.

Figure 7A:
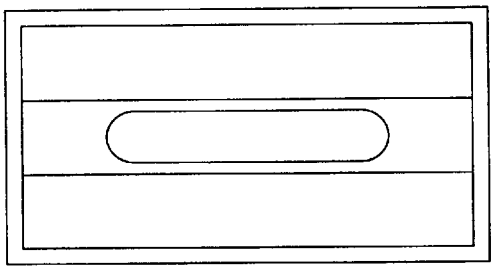
FIGS. 7*a*, 7*b*, 7*c*, 7*d*, 7*e*, 7*f*, 7*g* and 7*h* are schematic cross-sectional illustrations of bandstop filter elements for use in the waveguide of the present invention.

Other forms of bandstop filter, as illustrated in FIGS. 7*a*–7*h*, may also be employed. The filter shown in FIG. 7*a* is 3.4" long to fit WR-340 waveguide. The height is 0.75" and the thickness is 0.120". The loop is 2.232" inside the oval. The parallel bars are preferably rounded in cross-section to prevent arcing across the 0.5" gap. An earlier version with a 0.25 gap was prone to arcing.

Figure 7B:
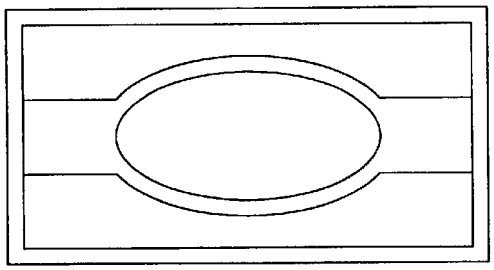
Figure 7C:
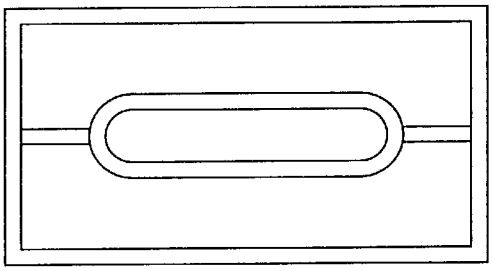
Figure 7D:
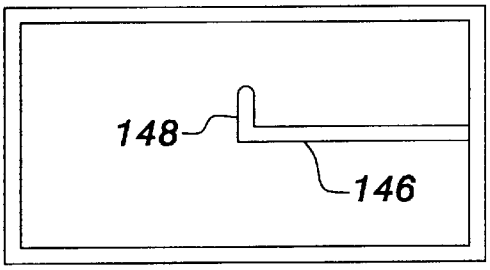
Figure 7E:
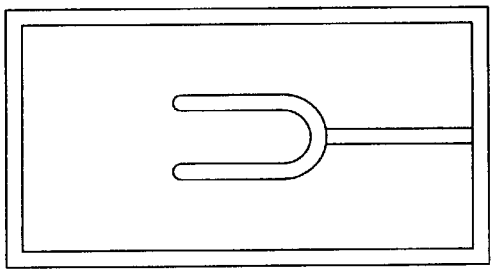
Figure 7F:
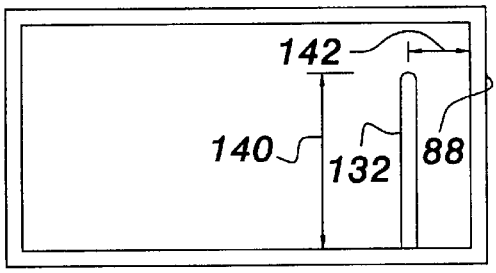
Figure 7G:
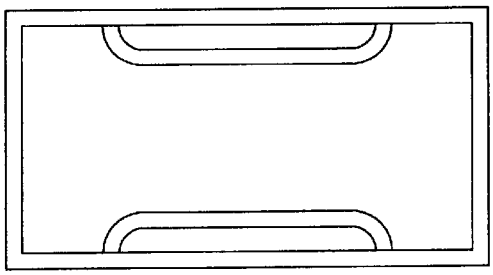
Figure 7H:
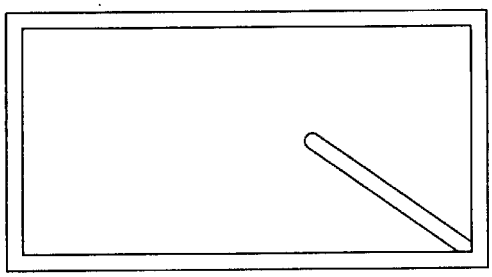

For the filter illustrated in FIG. 7*f*, a vertical rod 132 disposed near the sidewall 88 of waveguide 24 has a resonant frequency determined by its length 140 and coupling is determined by its displacement 142 from the waveguide wall 88. As illustrated in FIG. 7*d*, a horizontal rod 146 attached to sidewall 88 with asymmetrical tip 148 may also serve as a bandstop filter. An off-center screw (not shown), or a small tilt or bend (not shown) can be used to tune a filter having a rod element. FIG. 7*e* illustrates a loop type resonator cut in half to resemble a tuning fork 152. FIG. 7*g* shows a wire loop joined to the top or bottom waveguide wall. As illustrated in FIGS. 7*a*, 7*b* and 7*c*, the filter shape may be rectangular, elliptical or oval. Any of these variations may also be encased in a dielectric material to prevent arcing within the waveguide.

As illustrated in FIG. 6, waveguide end 104 must be extended to separate absorber 102 from the fields of the filter. The filter is primarily blocking the $TE_{10}$ mode of waveguide propagation. Near field energy at the selected frequency may pass through some of the embodiments illustrated in FIGS. 7*a*–7*h* such as the vertical rod of FIG. 7*f*, more than others, such as the centered oval loop illustrated in FIG. 7*c*. This may necessitate an extension of the distance 160 between absorber 102 and filter 100, as illustrated in FIG. 6.

The band rejection filter embodiment stops the production of out-of-band spurious signals; however, it also modifies the resonant tuning of the lamp, adding additional complexity to the design and perhaps increasing manufacturing difficulties. In the third embodiment illustrated in FIG. 8, one or more partially coupled lossy resonant circuits 200, tuned to the spurious out-of-band frequencies, are placed in the waveguide at high field strength locations for those out-of-band frequencies, as above. The lossy resonant circuits 200 have a controlled (i.e., tuned) internal loss which absorbs the greatest power at the spurious frequency. The narrower the bandwidth of the tuned absorber 200, the less useful power is absorbed at the magnetron selected frequency, since there is little current at that frequency. This embodiment is especially useful for the lamp assemblies with wideband magnetrons where spectral separation (between the selected frequency and spurious frequency) of greater than 100 MHZ is likely to occur.

Figure 8:
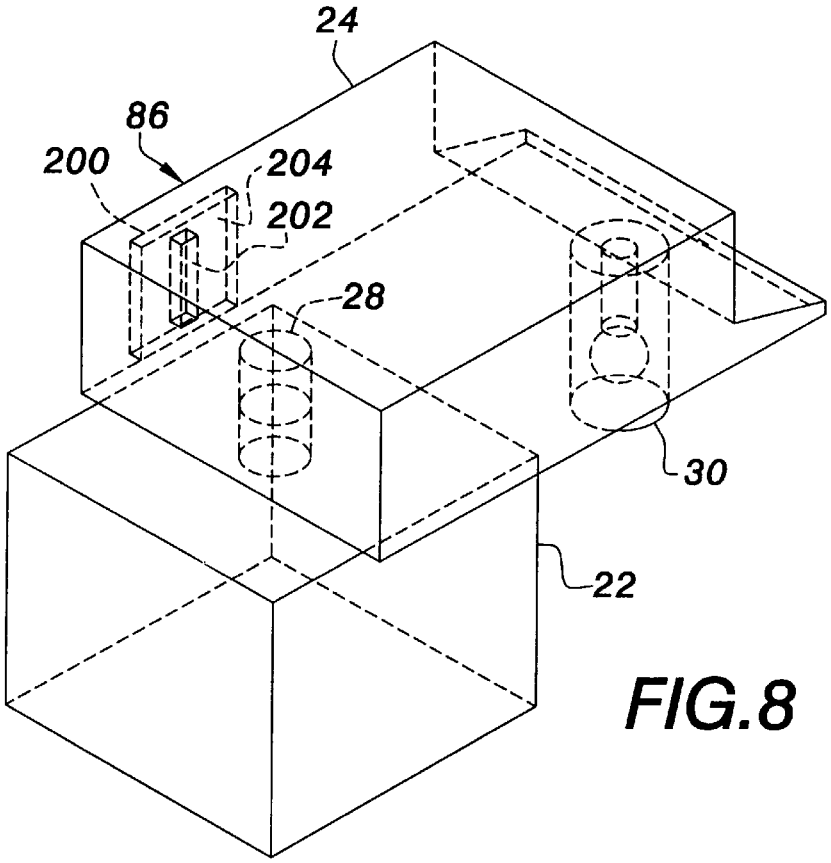
FIG. 8 is a schematic perspective illustration of a third embodiment of the lamp of the present invention, having a tuned resonant microstrip filter element situated in the waveguide.

In the embodiment of FIG. 8, the resonant circuit 200 includes a microstrip transmission line upper conductor 202 etched on a dielectric substrate 204. The back of the resonant circuit 200 is fully covered with metal and is attached to contact the wall of the waveguide. This insures predictable resonant frequency. The back foil could be omitted but any air space between the dielectric and the metal wall would raise the resonant frequency.

The microstrip resonator 200 is a transmission line confining current and electric field within the dielectric substrate area bounded by the upper conductor 202. If the upper conductor 202 were short-circuited to the ground plane at both ends, the length for resonance would be equal to one-half wavelength in the dielectric substrate 204. Preferably, the ends are not short-circuited and there is a fringing-field capacitance at each end extending the effective length. Thus, the resonant length is approximately onehalf wavelength minus twice the thickness of dielectric substrate 204. When the microstrip is used as a receiving antenna, the outer surface of the conductor 202 shields the resonator from external fields. The antenna functions as though the gaps at the ends were slots admitting fields to the interior. Thus, external coupling is proportional to the product of thickness of dielectric substrate 204 and the width of the upper conductor 202. The resonant bandwidth of the resonator is determined by losses on the metal surfaces and in the dielectric plus the coupling to external fields.

In ordinary usage, a microstrip receiving antenna is connected to a receiver by a microstrip conductor on its surface or by a lead wire through the substrate and ground plane. The impedance of the external load determines the performance of the microstrip antenna. The microstrip antenna losses only reduce antenna efficiency. However, in the present usage, lacking such external connections to a receiver, the losses within microstrip resonator 200 are the load and determine impedance and bandwidth.

For maximum absorption of an unwanted signal, the resonant microstrip circuit 200 is attached to a wall of the waveguide where currents at the resonant frequency are strong and run parallel to the length of upper conductor 202. In accordance with well known microstrip antenna practice, coupling can be reduced by use of a thinner dielectric substrate and a narrower upper conductor, each requiring a change in circuit length. In addition, coupling of a particular board may be reduced by rotating the upper conductor toward a direction perpendicular to the waveguide surface currents.

Figure 9A:
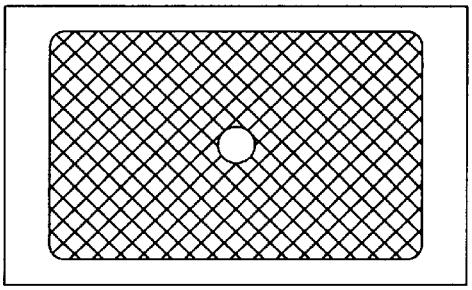
FIGS. 9*a*, 9*b* and 9*c* are schematic plan-view illustrations of microstrip filter elements for use in the third embodiment of the waveguide of the present invention.

A resonant microstrip absorber has been built by photolithography and etching as shown in FIG. 9*a*. The substrate material was FR4, a common circuit board material with moderate microwave loss. The board was 1.54" by 1" and 0.06" thick. The conducting pattern was 1.388" by 0.788" with a 0.130" hole for a mounting screw. Tests with the board on a WR-340 waveguide side wall showed the circuit to be resonant at 2079 MHZ with an under coupled resonance with reflection coefficient of 0.14 at resonance. Loaded bandwidth was 55 MHZ and unloaded Q was 65. At least half the incident power was absorbed by the filter from 2052 to 2106 MHZ.

With the third embodiment of FIG. 8, the loss in lamp efficiency or loss in forward power is reduced to approximately 1%, a further improvement over the efficiency for the first embodiment of FIG. 5 or the second embodiment of FIG. 6.

Narrow bandwidth filters require a lower dielectric loss substrate material than FR-4, e.g., Teflon-fiberglass composite, or the like.

Should greater spurious signal loss be needed than is available with a given circuit board material, extra loss could be added to the resonator. A small piece of carbon-coated card could be placed on top of the upper conductor 202 near the center thereof, placed to overhang the edges, such that some of the current on the underside of conductor 202 is spread to the resistive surface, increasing loss. For still greater loss, a gap may be included in the conductor under the resistor card. Magnetic loss material may similarly be placed adjacent to the edge, at the high current center of conductor 202. The greatest effectiveness is obtained if magnetic loss material is used in place of some of the substrate thickness between conductor 202 and the ground plane.

Figure 9B:
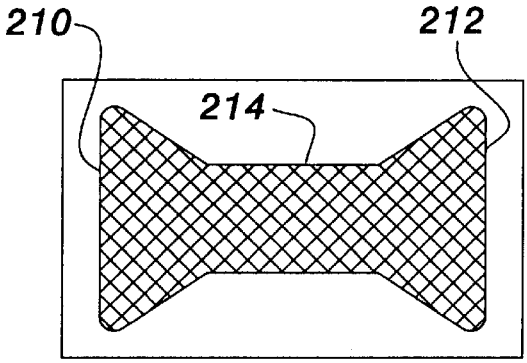
Figure 9C:
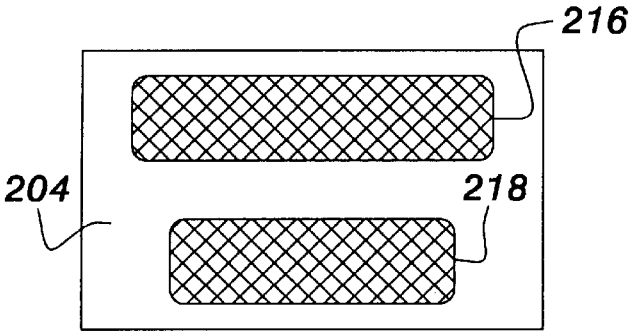

Turning now to FIGS. 9*a*, 9*b* and 9*c*, several variations of the microstrip resonant circuit are illustrated. FIG. 9*a* shows a constant width strip. The metal is etched back away from all edges of the substrate to allow the fringing fields to be contained within the dielectric. The corners of the strip are rounded to reduce peak electric fields which can occur at square corners, thus reducing the likelihood of arcing, should a high power signal occur at the resonant frequency. A hole is provided at the center for a fastener to attach the resonator to the waveguide wall.

Frequency is determined by the length of the metal strip, augmented by fringing fields at its tips as is well known in the patch or microwave antenna art. The length of strip required for a particular frequency to be absorbed may be reduced by shaping it as an hourglass shape as illustrated in FIG. 9*b*. The strip ends 210, 212 are capacitive while the center 214 is inductive. A narrow center 214 has more inductance and thus the resonant frequency and coupling are reduced.

The resonant absorbers 200 are made by common photoetching methods to obtain highly repeatable properties, well suited to large quantity manufacture. If a lamp requires suppression of several frequencies, multiple strips 216, 218 may be etched on a single dielectric substrate 204 (as illustrated in FIG. 9*c*), thereby providing a multi-frequency resonant absorber which is simple to install in a waveguide.

The resonant filters described herein are chosen for their compact size and ease of manufacture. Other forms of filters are well known in the literature. Some of these could also be incorporated to reduce interference; however, the size of the lamp system might thus be increased. For example, rectangular cavities with dimensions comparable to the waveguide cross-section could be coupled to either the narrow or the broad wall of the waveguide through appropriate slots.

Three embodiments have been disclosed herein, with variations on each of the three. In each, an energy absorber is disposed within the waveguide. In the first embodiment, a broadband lossy absorber 80 is made resonant, or frequency selective, by virtue of the position of the absorber within the waveguide. In the second embodiment, a band rejection filter is used to selectively allow only spurious energy to reach the (otherwise broadband) absorber 102, thus absorber 102 is resonant, or frequency selective, by virtue of its use in conjunction with filter 100. Finally, in the third embodiment, a frequency selective microstrip absorber 200 is disposed within the waveguide. In each case, the absorbers 80, 102 and 200 are tuned to absorb energy at the frequency of the spurious signal and so, for purposes of nomenclature, each of the three embodiments includes a resonant absorber.

The structure and method of the present invention is specially adapted to solve the problem described above in compact electrodeless lamp RF circuits, but is not limited to use with electrodeless lamps. Compact waveguide structures with highly resonant RF circuits may be used in conjunction with magnetrons in a number of applications, such as in microwave ovens or compact microwave transmitters. The resonant absorbers of the present invention can be utilized in such waveguides; any of the three preferred embodiments may be employed in overcoming problems with magnetron frequency pulling and related problems with RFI, as discussed above.

The foregoing describes the preferred embodiments of the present invention along with a number of possible alternatives. A person of ordinary skill in the art will recognize that modifications of the described embodiments may be made without departing from the true spirit and scope of the invention. The invention is therefore not restricted to the embodiments disclosed above, but is defined in the following claims.

What is claimed is:

1. An electrodeless lamp, comprising:

a source of high frequency electromagnetic energy at a selected frequency;

a light transmissive envelope, said envelope being filled with a substance which emits light when excited by high frequency electromagnetic energy at said selected frequency;

a waveguide having a wall, said waveguide being disposed to communicate electromagnetic energy from said source to said envelope;

an absorber disposed within said waveguide, said absorber being situated to absorb electromagnetic energy of a spurious signal at a second frequency displaced from said selected frequency, wherein said absorber is a lossy material which is disposed within said waveguide at a selected distance from said wall of said waveguide, wherein said selected distance corresponds to one quarter wavelength for said second frequency.

2. The electrodeless lamp of claim 1, wherein said lossy absorber comprises an electric field absorber.

3. The electrodeless lamp of claim 2, wherein said electric field absorber comprises silicon carbide.

4. The electrodeless lamp of claim 1, wherein said lossy absorber comprises a magnetic field absorber.

5. The electrodeless lamp of claim 4, wherein said magnetic field absorber comprises an iron compound dispersed in an elastomeric base.

6. The electrodeless lamp of claim 5, wherein said elastomeric base is rubber.

7. An electrodeless lamp, comprising:

a source of high frequency electromagnetic energy at a selected frequency;

a light transmissive envelope, said envelope being filled with a substance which emits light when excited by high frequency electromagnetic energy at said selected frequency;

a waveguide having a wall, said waveguide being disposed to communicate electromagnetic energy from said source to said envelope;

an absorber disposed within said waveguide, said absorber being situated to absorb electromagnetic energy of a spurious signal at a second frequency displaced from said selected frequency; and a band-rejection filter tuned to prevent transmission therethrough at said selected frequency and disposed within said waveguide, wherein said waveguide comprises an opening to communicate said electromagnetic energy from said source to said envelope and wherein said absorber is situated opposite said band-rejection filter with respect to said source of high frequency electromagnetic energy and said opening.

8. The electrodeless lamp of claim 7, wherein said band rejection filter is encased in a dielectric material.

9. The electrodeless lamp of claim 7, wherein said band rejection filter comprises a wire loop suspended in said waveguide.

10. The electrodeless lamp of claim 7, wherein said band rejection filter comprises a conductive rod having a proximal end and a distal end, said rod being suspended in said waveguide at said proximal end.

11. The electrodeless lamp of claim 10, wherein said band rejection filter conductive rod further includes an asymmetrical tip at said distal end of said rod.

12. The electrodeless lamp of claim 7, wherein said band rejection filter comprises a conductive oval suspended in said waveguide.

13. The electrodeless lamp of claim 7, wherein said band rejection filter comprises a fork suspended in said waveguide.

14. An electrodeless lamp, comprising:

a source of high frequency electromagnetic energy at a selected frequency;

a light transmissive envelope, said envelope being filled with a substance which emits light when excited by high frequency electromagnetic energy at said selected frequency;

a waveguide having a wall, said waveguide being disposed to communicate electromagnetic energy from said source to said envelope;

an absorber disposed within said waveguide, said absorber being situated to absorb electromagnetic energy of a spurious signal at a second frequency displaced from said selected frequency; wherein said absorber is a microstrip resonant circuit which is tuned to absorb power at said second frequency, and wherein said microstrip resonant circuit includes a microstrip upper conductor having a first narrow inductive section and a second wider capacitive section.

15. An electrodeless lamp, comprising:

a source of high frequency electromagnetic energy at a selected frequency;

a light transmissive envelope, said envelope being filled with a substance which emits light when excited by high frequency electromagnetic energy at said selected frequency;

a waveguide having a wall, said waveguide being disposed to communicate electromagnetic energy from said source to said envelope;

an absorber disposed within said waveguide, said absorber being situated to absorb electromagnetic energy of a spurious signal at a second frequency displaced from said selected frequency; wherein said absorber is a microstrip resonant circuit which is tuned to absorb power at said second frequency, and wherein said microstrip resonant circuit includes a first microstrip upper conductor tuned to said second frequency and a second microstrip upper conductor tuned to a third frequency.

16. An electrodeless lamp comprising:

a source of high frequency electromagnetic energy at a selected frequency;

a light transmissive envelope filled with a substance which emits light when excited by high frequency electromagnetic energy at said selected frequency;

a waveguide disposed to communicate electromagnetic energy from said source to said envelope;

a resonant absorber disposed within said waveguide situated to absorb electromagnetic energy at a second frequency;

wherein said resonant absorber is a microstrip resonant circuit tuned to absorb power at said second frequency; and wherein said microstrip resonant circuit includes a microstrip upper conductor having a first narrow and inductive section and a second wider and capacitive section.

17. A method for attenuating a signal at a spurious signal frequency within a waveguide in an electrodeless lamp assembly which includes an RF energy source operating at a selected frequency and a bulb which receives RF energy via the waveguide, said method comprising the steps of:

measuring said spurious signal frequency and a selected one of a spurious signal E-field maximum and a spurious signal H-field maximum;

determining a location in said waveguide for said selected one of said E-field maximum and said H-field maximum; and situating a lossy absorber in said waveguide proximate to said location for said selected one of said maxima.

18. A method for attenuating a signal at a spurious signal frequency within a waveguide in an electrodeless lamp assembly which includes an RF energy source operating at a selected frequency and a bulb which receives RF energy via an opening in the waveguide, said method comprising the steps of:

positioning a band rejection filter within said waveguide, said band rejection filter being tuned to the selected frequency; and positioning an absorber within said waveguide, opposite said band rejection filter with respect to the RF source and the opening.

19. A compact RF circuits comprising:

a magnetron source of high frequency electromagnetic energy at a selected frequency;

a load excited by high frequency electromagnetic energy at said selected frequency;

a waveguide having a wall, said waveguide being disposed to communicate electromagnetic energy from said magnetron to said load;

a resonant absorber disposed within said waveguide, said absorber being situated to absorb electromagnetic energy of a spurious signal at a second frequency displaced from said selected frequency, wherein said resonant absorber is a lossy material which is disposed within said waveguide at a selected distance from said wall of said waveguide, wherein said selected distance corresponds to one quarter wavelength for said second frequency.

20. The compact RF circuit of claim 19, wherein said lossy absorber comprises an electric field absorber.

21. The compact RF circuit of claim 20, wherein said electric field absorber comprises silicon carbide.

22. The compact RF circuit of claim 19, wherein said lossy absorber comprises a magnetic field absorber.

23. The compact RF circuit of claim 22, wherein said magnetic field absorber comprises an iron compound dispersed in a rubber base.

24. A compact RF circuit, comprising:

a magnetron source of high frequency electromagnetic energy at a selected frequency;

a load excited by high frequency electromagnetic energy at said selected frequency;

a waveguide having a wall, said waveguide being disposed to communicate electromagnetic energy from said magnetron to said load;

a resonant absorber disposed within said waveguide, said absorber being situated to absorb electromagnetic energy of a spurious signal at a second frequency displaced from said selected frequency; and a band-rejection filter tuned to prevent transmission therethrough at said selected frequency and disposed within said waveguide, wherein said waveguide comprises an opening to communicate said electromagnetic energy from said magnetron to said load and wherein said resonant absorber is situated opposite said band-rejection filter with respect to said magnetron and said load.

25. The compact RF circuit of claim 24, wherein said band rejection filter is encased in a dielectric material.

26. The compact RF circuit of claim 24, wherein said band rejection filter comprises a wire loop suspended in said waveguide.

27. The compact RF circuit of claim 24, wherein said band rejection filter comprises a conductive rod having a proximal end and a distal end, said rod being suspended in said waveguide at said proximal end.

28. An electrodeless lamp, comprising:

a source of high frequency electromagnetic energy at a selected frequency;

a light transmissive envelope, said envelope being filled with a substance which emits light when excited by high frequency electromagnetic energy at said selected frequency;

a waveguide having a wall, said waveguide being disposed to communicate electromagnetic energy from said source to said envelope;

an absorber disposed within said waveguide, said absorber being situated to absorb electromagnetic energy of a spurious signal at a second frequency displaced from said selected frequency, wherein said absorber is situated in said waveguide proximate to a location of one of an E-field maximum of the spurious signal and an H-field maximum of the spurious signal.

29. The electrodeless lamp of claim 28, wherein said absorber has a negligible effect on energy at the selected frequency.

30. An electrodeless lamp, comprising:

a source of high frequency electromagnetic energy at a selected frequency;

a light transmissive envelope, said envelope being filled with a substance which emits light when excited by high frequency electromagnetic energy at said selected frequency;

a waveguide having a wall, said waveguide being disposed to communicate electromagnetic energy from said source to said envelope;

an absorber disposed within said waveguide, said absorber being situated to absorb electromagnetic energy of a spurious signal at a second frequency displaced from said selected frequency; wherein said absorber is a microstrip resonant circuit which is tuned to absorb power at said second frequency, and wherein said microstrip resonant circuit includes a receiving antenna comprising a microstrip conductor having dimensions adapted to receive energy of the spurious signal at the second frequency.

31. The electrodeless lamp of claim 30, wherein said microstrip resonant circuit absorbs a negligible amount of energy at the selected frequency.

32. A compact RF circuits comprising:

a magnetron source of high frequency electromagnetic energy at a selected frequency;

a load excited by high frequency electromagnetic energy at said selected frequency;

a waveguide having a wall, said waveguide being disposed to communicate electromagnetic energy from said magnetron to said load;

a resonant absorber disposed within said waveguide, said absorber being situated to absorb electromagnetic energy of a spurious signal at a second frequency displaced from said selected frequency, wherein said resonant absorber is situated in said waveguide proximate to a location of one of an E-field maximum of the spurious signal and an H-field maximum of the spurious signal.

33. The compact RF circuit of claim 32, wherein said resonant absorber has a negligible effect on energy at the selected frequency.

34. A compact RF circuit, comprising:

a magnetron source of high frequency electromagnetic energy at a selected frequency;

a load excited by high frequency electromagnetic energy at said selected frequency;

a waveguide having a wall, said waveguide being disposed to communicate electromagnetic energy from said magnetron to said load;

a resonant absorber disposed within said waveguide, said absorber being situated to absorb electromagnetic energy of a spurious signal at a second frequency displaced from said selected frequency, wherein said resonant absorber is a microstrip resonant circuit which is tuned to abosrb power at said second frequency, and wherein said microstrip resonant circuit includes a receiving antenna comprising a microstrip conductor having dimensions adapted to receive energy of the spurious signal at the second frequency.

35. The compact RF circuit of claim 34, wherein said microstrip resonant circuit absorbs a negligible amount of energy at the selected frequency.

* * * * *